US005587584A

United States Patent [19]

Bergen

[11] Patent Number: 5,587,584

[45] Date of Patent: Dec. 24, 1996

[54] APPARATUS FOR CHARGING A FILM ON THE INTERNAL SURFACE OF A DRUM

[75] Inventor: Richard F. Bergen, Ontario, N.Y.

[73] Assignee: Xerox Corporation, Stamford, Conn.

[21] Appl. No.: 623,800

[22] Filed: Mar. 28, 1996

[51] Int. Cl.[6] ..... H01T 19/04

[52] U.S. Cl. ..... 250/325; 250/324; 250/326; 361/229; 355/224

[58] Field of Search ..... 250/325, 324, 250/326; 355/221, 225, 224; 361/229, 230; 346/94, 125, 132

[56] References Cited

U.S. PATENT DOCUMENTS

| | | | |
|---|---|---|---|
| 2,588,699 | 3/1952 | Carlson | 95/1.9 |
| 2,777,957 | 1/1957 | Walkup | 250/19.5 |
| 3,598,991 | 8/1971 | Nost | 250/49.5 |
| 3,783,283 | 1/1974 | Smith, Jr. | 250/325 |
| 4,086,650 | 4/1978 | Davis et al. | 361/229 |
| 4,100,411 | 7/1978 | Davis | 250/324 |
| 4,155,093 | 5/1979 | Fotland et al. | 346/159 |
| 4,174,170 | 11/1979 | Yamamato et al. | 355/3 T |
| 4,463,363 | 7/1984 | Gundlach et al. | 346/159 |
| 4,524,371 | 6/1985 | Sheridon et al. | 346/159 |
| 4,841,146 | 6/1989 | Gundlach et al. | 250/324 |
| 4,963,738 | 10/1990 | Gundlach et al. | 250/325 |
| 4,999,733 | 3/1991 | Kukuda | 250/325 |
| 5,411,825 | 5/1995 | Tam | 430/41 |

*Primary Examiner*—Jack I. Berman
*Assistant Examiner*—Kiet T. Nguyen
*Attorney, Agent, or Firm*—William A. Henry, II

[57] ABSTRACT

A scorotron charging unit for charging Verde film residing on the inner surface of an imagesetter drum has a charging region that encompasses a 270° sector of the drum. The scorotron is fashioned by attaching a metallic strip coronode having a sawtooth edge around a section of pipe. Each tooth of the sawtooth strip is bent to an angle of about 90° with respect to the surface of the pipe. This pipe is slipped inside another pipe that includes a slit for the passage of ions in the direction of the Verde film, thus forming a scorotron. The scorotron while sliding through the drum holding this film, charges the film to sensitize it for imaging.

6 Claims, 2 Drawing Sheets

APPARATUS FOR CHARGING A FILM ON THE INTERNAL SURFACE OF A DRUM

BACKGROUND OF THE INVENTION

Field of the Invention

This invention relates to a novel ion charging apparatus wherein ions are generated interiorly of a drum and passed through a narrow conductive exit slit to in order to uniformly charge a charge receptor mounted on the internal surface of the drum.

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charge to the receiver more efficiently, but compromises the control function of the device.

Other methods exist for trying to obtain uniform charging from negative charging systems such as dicorotron charging devices as shown in U.S. Pat. No. 4,086,650 that includes glass coated wires and large specialized AC power supplies.

Various ion generating devices are available for printing or charging purposes. For example, in U.S. Pat. No. 4,463,363 there is taught a D.C. air breakdown form of ion generator. In U.S. Pat. No. 4,524,371 a fluid jet assisted ion projection printing apparatus is disclosed that includes a housing having ion generation and ion modulation regions. A bent path channel, disposed through the housing, directs transport fluids with ions entrained therein adjacent an array of modulation electrodes which control the passage of ion beams from the device. Emission of charged particles in U.S. Pat. No. 4,155,093 is accomplished by extracting them from a high density source provided by an electrical gas breakdown in an alternating electrical field between two conducting electrodes separated by an insulator. A corona discharge unit is used in conductive toner transfer in a copier in U.S. Pat. No. 4,174,170. The corona discharge unit includes a slit to permit transfer of conductive toner particles onto a copy paper charged by the corona unit. A corona wire in the unit is surrounded by a shield. U.S. Pat. No. 3,396,308 discloses a web treating device for generating a flow of ionized gas. This device includes an opening through which the gas is directed towards a receptor surface. An elongated hollow housing 11 has tapered sides 14 terminating in a pair of lips 15 which form a narrow and elongated slot 16. U.S. Pat. Nos. 3,598,991 and 4,100,411 show electrostatic charging devices including a corona wire surrounded by a conductive shield. In U.S. Pat. No. 3,598,991, a slit 13 is formed in the shield to allow ions to flow from wire 12 to a photoconductive surface 2 to deposit an electric charge thereon. In U.S. Pat. No. 4,100,411, a pair of lips 16 and 17 define a corona ion slit 18. Japanese Patent Document No. 55-73070 discloses a powder image transfer type electrostatic copier that includes a corona discharge device having a slit in a shield plate. In Japanese Patent Document No. 54-156546 a corona charge is shown having a plurality of grating electrodes in the opening part of a corona shield electrode. U.S. Pat. 4,591,713 shows a miniaturized scorotron that includes a sawtooth coronode partially surrounded by a conductive shield with a control screen attached to the shield. The control screen is closely spaced to a receiver surface such that fringing fields between the screen and receiver surface contribute significantly to both efficient ion pumping and potential leveling. These devices have not been entirely satisfactory in that they are costly, some of them are hard to fabricate and most are inefficient.

In addition, the problem of uniformity of charge is more pronounced when migration imaging is attempted using Verde film that is disclosed in U.S. Pat. No. 5,411,825. In contrast to typical copiedprinter speeds which are nearer to 4 inches per second, the process speed for Verde film is very slow and at times less than 4 inches per minute. In a configuration where the Verde film must be supported against the concave inner surface of a cylinder, charging of the film must progress paraxially in order to reduce the time between charging and laser exposing steps.

SUMMARY OF THE INVENTION

Accordingly, a charging apparatus is provided for use in any of the various printing and imaging processes. The charging apparatus of the present invention overcomes the above-described problems and disadvantages of conventional charging devices.

Specifically, this invention in one embodiment provides a scorotron charging device with a metallic strip wrapped around an insulating core. The metallic strip includes a row of pin like elements at one edge thereof that are bent orthogonal to the outer surface of the insulating core. Two conductive elements forming a slit are positioned around the insulating core and above the pins of the metallic strip to form a scorotron. The charging device is traversed back and forth internally of the drum in order to charge Verde film on the inner circumference of the drum.

BRIEF DESCRIPTION OF THE DRAWINGS

Other features of the present invention will become apparent as the following description proceeds and upon reference to the drawings in which.

DETAILED DESCRIPTION OF THE INVENTION

Figure 1:
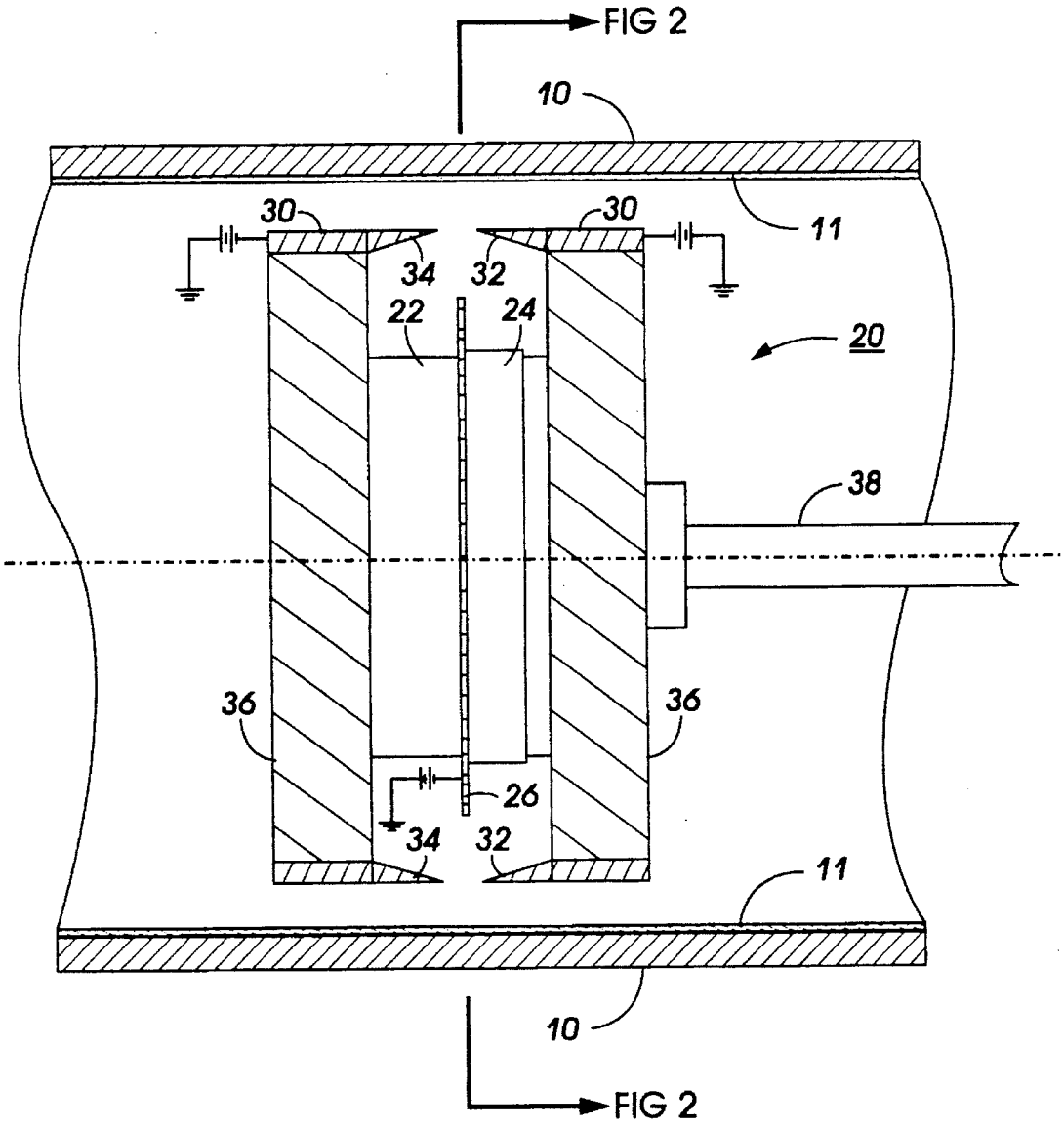
FIG. 1 is an enlarged elevational view of a charging unit that incorporates a sawtooth electrode in the unit in accordance with one aspect of the present invention.

While the invention will be described hereinafter in connection with a preferred embodiment, it will be understood that no intention is made to limit the invention to the described embodiment. On the contrary, it is intended to cover all alternatives, modifications, and equivalents as may be included within the spirit and scope of the invention as defined by the appended claimed.

For a general understanding of the features of the invention, reference is had to the drawings. In the drawings, like reference numerals have been used throughout to designate identical elements.

In accordance with an aspect of the present invention, FIG. 1 depicts a novel charging device 20 for charging a film 11, such as, Verde film mounted on the internal surface of a drum 10. Verde film is available from Xerox Corporation. Charging device 20 comprises a cylindrical insulating core member 22 that has a conventional berrilium copper corona generating strip 24 wrapped around 270° of the core member. Strip 24 has a sawtooth edge that includes a series of teeth 26 extending therefrom in the same plane as the body of strip 24. Thus, strip 24 is bent to form a curved surface concentric with the concave surface of the Verde Film 11. A conventional power source (not shown) is connected to corona generating strip 24 in order to produce ions at the tips of teeth 26 as required. Teeth 26 of corona generating strip 24 are bent to project about 3 mm orthogonally with respect to the outer surface of insulating core 22 so that the corona charge generated from the tips of teeth 26 are driven to and through the slit to follow the field lines to the surface of film 11 that is parallel to the array of teeth 26. A conductive ring 30, such as, stainless steel includes wedge shaped members 32 and 34 that form a slit of preferably about 0.03" in width for the passage of ions therethrough emitted from the tips of teeth 26. The slit width could vary from about 0.020 to about 0.2 inches. Ring 30 has, for example, an outside radius of about 110 mm while insulating core 22 positioned inside ring 30 has, for example, an outside radius of about 100 mm. With insulating core 22 positioned within ring 30, charging device 20 becomes a scorotron. Ring 30 includes wedge shaped portions 32 and 34 having inclined surfaces angled at about 15° with respect to the outside surface of ring 30. An insulating support ring 36 is positioned inside ring 30 and has insulating core 22 attached to it as well. A shaft 38 is connected to one end of insulating support 36 and is pushed by conventional means forward and pulled backward in order to move charging device 20 along the interior of drum 10 for charging film 11.

Figure 2:
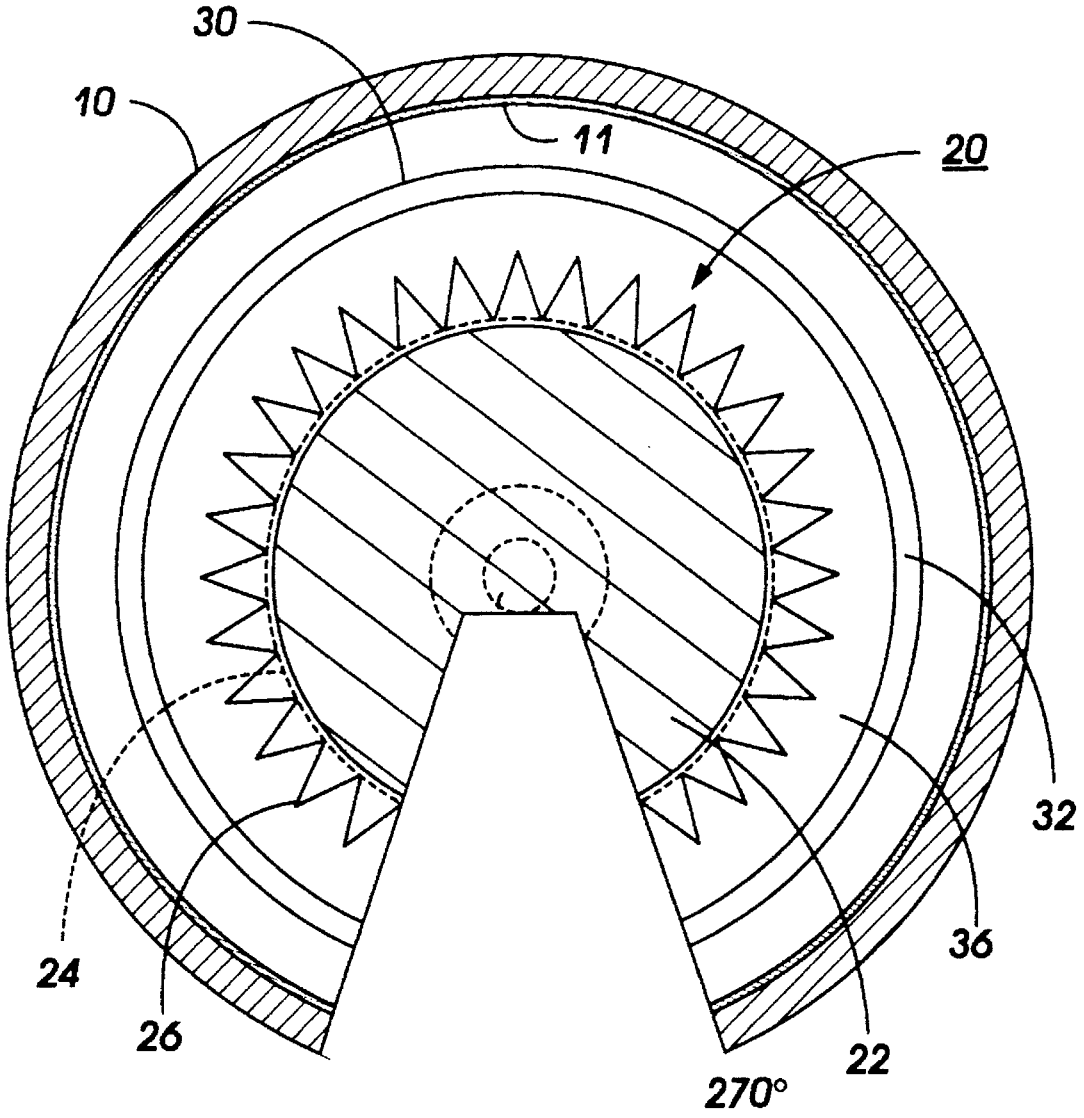
FIG. 2 is an enlarged end view of the charging device of FIG. 1 positioned to charge film mounted on the interior surface of the drum.

As shown in FIG. 2, drum 10 covers about 270° and has a circle-like charging device 20 traversing longitudinally thereof. An insulating core 22 of charging device 20 has a metallic ribbon coronode 24 wrapped around its circumference with pin-like projections 26 of metallic ribbon 24 being bent at a 90° angle with respect to the circumference of insulating core 22. Insulating ring 36 supports insulating core 22 and stainless steel wedge ring 30. Ions emitted from the pin-like projections of coronode 24 follow field lines through a slit in wedge ring 30 to the surface of Verde film 11 attached to the inner surface of drum 10.

It should now be apparent that a novel charging apparatus has been disclosed for charging charge retentive surfaces, and especially for charging film supported on the interior surface of a drum, that comprises a sawtooth ribbon coronode unit circular in configuration with a concentric slit that makes it a scorotron charging unit.

While the invention has been particularly shown and described with reference to preferred embodiments thereof, it will be understood by those skilled in the art that various changes in form and details may be made therein without departing from the spirit and scope of the invention.

What is claimed is:

1. A scorotron charging apparatus adapted to apply an ion charge to a film positioned on the interior circumference of a drum, comprising:

an insulating core member having an outer surface;

a metallic strip coronode wrapped around said insulating core, said metallic strip coronode having a series of teeth on one edge thereof that are bent orthogonal to said outer surface of said insulating core member; and a conductive ring mounted surrounding said insulating core member, said conducting ring having a slit therein overlying said series of teeth of said coronode and through which ions exit to charge the film.

2. The scorotron charging apparatus of claim 1, wherein said conductive ring is mounted on a circular insulating member.

3. The scorotron charging apparatus of claim 2, further including means for supporting said insulating core member and means for moving said insulating core member longitudinally of said drum.

4. The scorotron charging apparatus of claim 3, wherein said conductive ring includes a pair of beveled portions.

5. The scorotron charging apparatus of claim 4, wherein said beveled portions of said conductive ring include an angle of about 15 degrees.

6. The scorotron of claim 5, said slit in said conducting ring is about 0.03 inches in width.

* * * * *